US006477858B2

(12) United States Patent
Nobuta et al.

(10) Patent No.: US 6,477,858 B2
(45) Date of Patent: Nov. 12, 2002

(54) REFRIGERATION CYCLE APPARATUS

(75) Inventors: Tetsuji Nobuta, Kariya (JP); Takahisa Suzuki, Kariya (JP); Keisuke Nagai, Toyota (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/992,305

(22) Filed: Nov. 19, 2001

(65) Prior Publication Data

US 2002/0059806 A1 May 23, 2002

(30) Foreign Application Priority Data

Nov. 20, 2000 (JP) ..... 2000-353366

(51) Int. Cl.[7] ..... F25B 39/04
(52) U.S. Cl. ..... 62/509
(58) Field of Search ..... 62/509, 473; 165/132, 165/173

(56) References Cited

U.S. PATENT DOCUMENTS 5,592,830 A * 1/1997 Baba et al. ..... 62/509
5,927,102 A * 7/1999 Matsuo et al. ..... 62/509
6,374,632 B1 * 4/2002 Nobuta et al. ..... 62/509

FOREIGN PATENT DOCUMENTS

JP 2000-74527 3/2000

* cited by examiner

*Primary Examiner*—Denise L. Esquivel
*Assistant Examiner*—Melvin Jones
(74) *Attorney, Agent, or Firm*—Harness, Dickey & Pierce, PLC

(57) ABSTRACT

The refrigerant cycle apparatus comprises a communication pipe 32 which is an upper refrigerant flow-in means allowing the refrigerant which has passed through a condenser 2 to flow into the upper part of a liquid receiver 31, and a communication hole 33 which is a lower refrigerant flow-in means allowing the refrigerant which has passed through the condenser 2 to flow into the lower part of the liquid receiver 31, and the flow rate (Gr1) of refrigerant flowing into the upper part of the liquid receiver 31 from the communication pipe 32 is set at a value between 30 kg/h and 110 kg/h.

As a result of this, preventing heat damage due to the heat given to the liquid receiver from the outside and securing the good bubble disappearing characteristic of the liquid refrigerant flowing out from the liquid receiver are mutually compatible, and thereby an improved refrigerant filling characteristic may be obtained.

6 Claims, 8 Drawing Sheets

REFRIGERATION CYCLE APPARATUS

BACKGROUND OF THE INVENTION

1. Field of the Invention

The present invention relates to a refrigeration cycle apparatus, having a liquid receiver for separating gas and liquid in the refrigerant which has passed through a refrigerant condenser to accumulate the liquid refrigerant, the refrigeration cycle apparatus having an improved refrigerant filling characteristic in the refrigeration cycle and preferably being used for a air conditioner for a vehicle.

2. Description of the Related Art

The applicant has proposed, in the Japanese Unexamined Patent Publication No. 2000-74527, a refrigeration cycle apparatus which allows the refrigerant, which has passed through a refrigerant condenser and has been condensed, to flow into a liquid receiver from upper and lower paths.

According to this refrigeration cycle apparatus, due to the cooling effect of the liquid refrigerant flowing into the upper space in the liquid receiver, the refrigerant in the upper space in the liquid receiver is not gasified by the heat from the outside. For this reason, the space in the liquid receiver may be used effectively for accumulating the liquid refrigerant up to the upper space.

The inventors have learned, specifically when investigating and evaluating the above prior art, that the refrigerant filling characteristic widely fluctuates according to the flow rate of the refrigerant flowing into the liquid receiver from the upper part thereof.

SUMMARY OF THE INVENTION

It is therefore an object of the present invention to provide a refrigeration cycle apparatus having an improved refrigerant filling characteristic, wherein preventing heat damage due to the heat given to the liquid receiver from the outside and securing a good bubble disappearing characteristic in the liquid refrigerant flowing out from the liquid receiver may be mutually compatible because the flow rate of the refrigerant flowing into the liquid receiver from the upper part thereof is specifically set at a suitable value.

In order to achieve the above object, the present invention provides a refrigerant cycle apparatus comprising an upper refrigerant flow-in means (32) allowing the refrigerant which has passed through a condenser (2) to flow into the upper part of a liquid receiver (31) and a lower refrigerant flow-in means (33, 330) allowing the refrigerant which has passed through the condenser (2) to flow into the lower part of the liquid receiver (31), wherein the flow rate (Gr1) of refrigerant flowing into the upper part of the liquid receiver (31) from the upper refrigerant flow-in means (32) is set at a value between 30 kg/h and 110 kg/h.

It has become apparent from analysis of an experiment by the inventors that the wall around the upper space of the liquid receiver (31) is effectively cooled by the refrigerant flowing into the liquid receiver (31) from the upper part thereof when the flow rate (Gr1) of refrigerant flowing into the upper part of the liquid receiver (31) from the upper refrigerant flow-in means (32) is set at 30 kg/h or more. For this reason, it is clear that gasifying of the refrigerant in the liquid receiver (31) may be restricted effectively even under the condition that heat is given to the liquid receiver (31) from the outside (for example, when the hot air which has passed through the condenser and radiator turns to the front of the condenser at engine idling), and thereby the space in the liquid receiver (31) may be effectively used to accumulate the liquid refrigerant.

As a result, an "overfilling cycle condition" which happens when the refrigerant to be originally accumulated in the liquid receiver (31) overflows to the condenser (2), may be restricted and, thereby, an undesired state such as increase of compressor power (decrease of COP (Coefficient of Performance)) resulted from the overfilling cycle condition may be prevented.

Furthermore, it has become apparent from an analysis of experiments by the inventors that instability in the level of the liquid refrigerant in the liquid receiver (31), resulting from the dynamic pressure which arises when the refrigerant flows into the liquid receiver (31) from the upper side thereof, may be restricted by limiting the flow rate (Gr1) of the refrigerant flowing into the upper part of the liquid receiver (31) from the upper refrigerant flow-in means (32) to 110 kg/h or less, and thereby mixing of the gas refrigerant into the liquid refrigerant which flows out from the liquid receiver (31) may be restricted. In result, the good bubble disappearing characteristic of the liquid refrigerant may be secured, and thereby the refrigerant filling characteristic may be improved.

BRIEF DESCRIPTION OF THE DRAWINGS

The present invention may be more fully understood from the description of the preferred embodiments of the invention set forth below, together with the accompanying drawings wherein.

DESCRIPTION OF THE PREFERRED EMBODIMENTS (First Embodiment)

Figure 1:
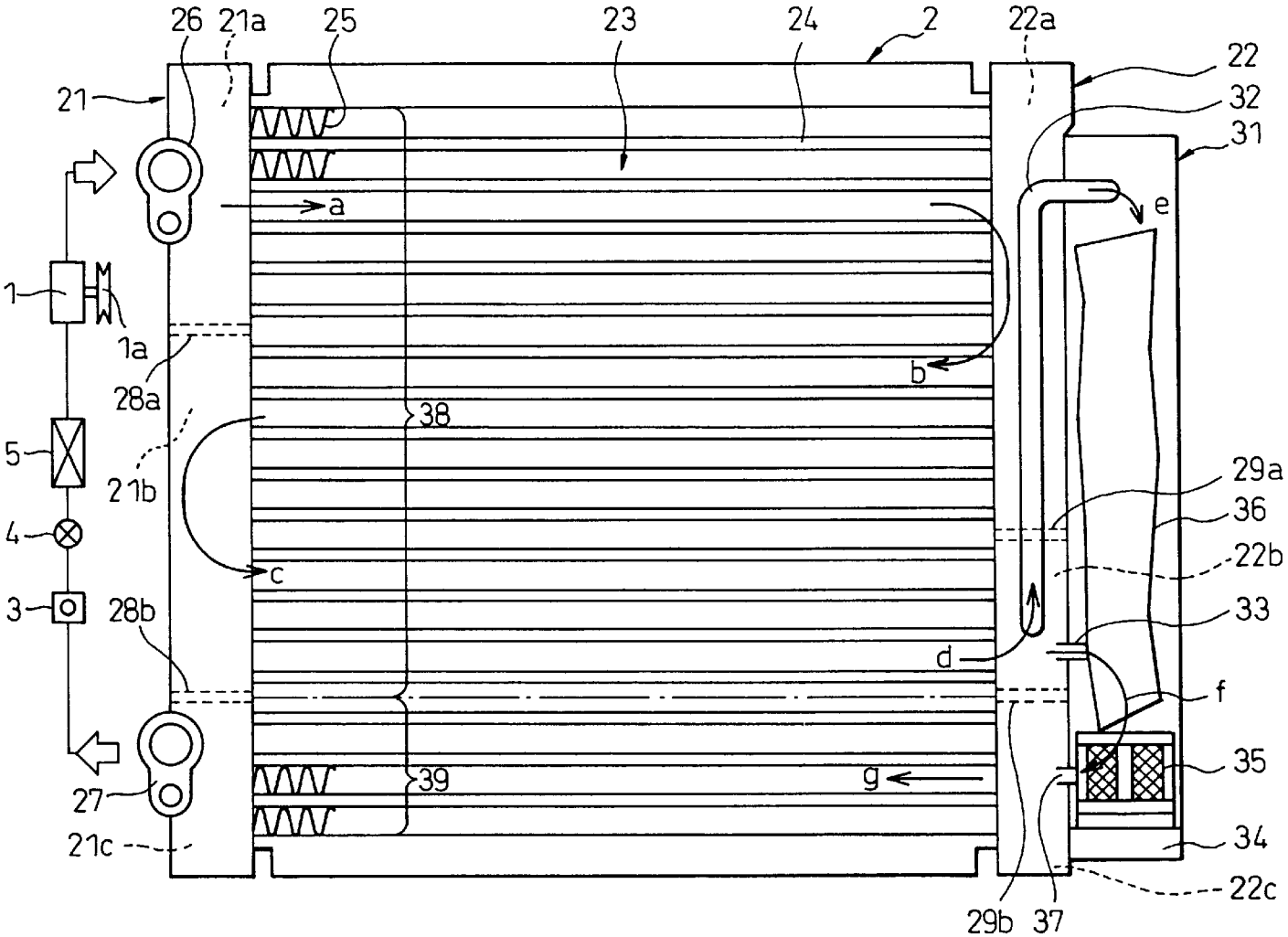
FIG. 1 is a front view of a refrigerant condenser of the first embodiment of the present invention, including a sectional view of a liquid receiver.

FIG. 1 shows the first embodiment of the present invention, which is a liquid receiver integrated refrigerant condenser of an air conditioner for a motor vehicle, in which the spirit of the present invention is implemented. This refrigeration cycle apparatus of an air conditioner for motor vehicle consists of a closed circuit in which a refrigerant compressor 1, a liquid receiver integrated refrigerant condenser 2, a sight glass 3, a thermostatic expansion valve 4, and a refrigerant evaporator 5 are connected in series by refrigerant tubes such as metal pipes or rubber hoses.

The refrigerant compressor 1 is connected to a driving engine disposed in the engine compartment of a motor vehicle via a belt and a magnetic clutch 1*a*. When the magnetic clutch 1*a* is ON and the power of the engine is transferred to the refrigerant compressor 1, the refrigerant compressor 1 takes in the gas refrigerant on the down stream of the refrigerant evaporator 5 and compresses the gas refrigerant, and then discharges the high-temperature and high-pressure superheated gas refrigerant into the liquid receiver integrated refrigerant condenser 2.

The sight glass 3 is used for a worker to do a visual inspection of the gas-liquid condition of the refrigerant flowing out from the outlet tube joint 27 of the liquid receiver integrated refrigerant condenser 2 and to check whether the amount of refrigerant filled in the refrigeration cycle is proper or not. The thermostatic expansion valve 4 works as a pressure reducing means which decompresses and expands the high-temperature and high pressure refrigerant to turn it into a fog state having two phases of gas and liquid. The refrigerant evaporator 5 works as a cooling means for cooling air sent into the passenger compartment of the vehicle.

The liquid receiver integrated refrigerant condenser 2 is described in more detail below. The condenser 2 is equipped with a pair of header tanks, a first and second header tanks 21, 22, disposed at a predetermined interval, which are formed substantially in cylinder style extending in vertical direction. Between the first and second header tanks 21, 22, a core portion 23 for heat exchange is disposed.

The refrigerant condenser 2 in this embodiment is generally known as multi-flow type. The core portion 23 has a number of flat tubes which are disposed in parallel between the first and second header tanks 21, 22, and allows the refrigerant to flow horizontally. The flat tubes are joined via corrugated fins 25. The flat tube communicates with the first header tank 21 at one end, and with the second header tanks 22 at the other end.

A refrigerant inlet tube joint (refrigerant inlet portion) 26 is joined on the upper part of the first header tank 21, while a refrigerant outlet tube joint (refrigerant outlet portion) 27 is joined on the lower part of the first header tank 21.

In addition, in this embodiment, two partitions, a first and second partitions 28*a*, 28*b*, are disposed in the first header tank 21, while two partitions, a third and fourth partitions, are disposed in the second header tank 22. By these partitions, spaces in the first and second header tanks 21, 22 are divided into three compartments 21*a*, 21*b*, 21*c* and 22*a*, 22*b*, 22*c* respectively in vertical direction. Such configuration allows the refrigerant from the inlet tube joint 26 to meander as indicated by arrows (a) to (g) through the first and second header tanks 21, 22 and the core portion 23.

In this configuration, the third partition 29*a*, which is the upper partition in the second header tank 22, is disposed on the level lower than the first partition 28*a* which is the upper partition in the first header tank 21, while the second partition 28*b* which is the lower partition in the first header tank 21, and the fourth partition 29*b* which is the lower partition in the second header tank 22, are disposed on the same level.

In addition, the second header tank 22 is integrated with a liquid receiver 31 for separating gas and liquid in the refrigerant to accumulate the liquid refrigerant. The liquid receiver 31 is formed substantially in cylinder style and is slightly lower than the second header tank 22. The liquid receiver 31 is disposed on the outer side (the side other than the side facing the core portion 23) of the second header tank 22, and is integrated with the second header tank 22.

In this embodiment, each portion of the refrigerant condenser 2 and the liquid receiver 31 are made up of aluminum components, and are assembled by means of soldering.

The liquid receiver 31 and the second header tank 22 communicates each other as described below. A communication tube 32 is an upper refrigerant flow-in means through which the refrigerant flows into the upper space in the liquid receiver 31, and the communication tube 32 is disposed vertically along with the outer surface of the second header tank 22. The communication tube 32 communicates with the middle compartment 22*b* of the second header tank 22 at one end, and with the space near the ceiling (uppermost portion) in the liquid receiver at the other end.

In addition, a communication hole 33 is a lower refrigerant flow-in means through which the refrigerant flows into the lower space in the liquid receiver 31, and the communication hole 33 is disposed at the position vertically corresponding to the middle compartment 22*b* and is formed through the walls of the second header tank 22 and the liquid receiver 31. Thus, the middle compartment 22*b* of the second header tank 22 directly communicates with the lower space in the liquid receiver 31 through the communication hole 33.

On the other hand, the bottom of the liquid receiver 31 of substantially a cylinder style is closed with a mounting base 34. The mounting base 34 is fixed to the cylinder style body of the liquid receiver through sealing material (not shown) with screws so as to be airtight and can be attached and removed. A filter 35 for eliminating foreign objects is mounted on the top of the mounting base 34 and is integrated with it. The filter 35 consists of a cylindrical net. A desiccant 36 for absorbing water is disposed above the filter 35. The desiccant 36 accommodates a particulate desiccant in a suitable bag through which the refrigerant can flow.

In addition, a communication hole 37 is provided on a portion lower than the fourth partition 29*b* of the wall between the header tank 22 and the liquid receiver 31, through which the lower space near the bottom of the liquid receiver 31 communicates with the lower compartment 22*c* of the second header tank 22.

The liquid refrigerant in the lower part of the liquid receiver 31 contacts with the desiccant 36 and then flows into the inside of the filter 35 consisting of a cylindrical net as indicated by the arrow (f). The liquid refrigerant then flows from the inside of the filter 35 into the lower compartment 22*c* through the communication hole 37. Thus, the communication hole 37 is a refrigerant flow-out means which allows the liquid refrigerant in the liquid receiver 31 to flows out into the lower compartment 22*c*. In the core portion 23, a portion above the second and fourth partitions 28*b*, 29*b* is a condensing portion 38 which transfers the heat from the gas refrigerant discharged from the refrigerant compressor 1 to the air sent from the outside of the room by a cooling fan (not shown), thereby cooling and condensing the refrigerant. Further, in the core portion 23, a portion under the second and fourth partitions 28*b*, 29*b* is a supercooling portion 39 which transfers the heat from the liquid refrigerant separated from gas-liquid refrigerant in the liquid receiver to the air sent from the outside of the room, thereby supercooling the liquid refrigerant.

As described above, the refrigerant condenser 2 comprising the condensing portion 38, the liquid receiver 31 and the supercooling portion 39, which are disposed in the order of the flow of the refrigerant and are integrated. In addition, the interface between gas and liquid refrigerants is on a middle level between the third partition 29*a* and the top of the liquid receiver 31 when the normal amount of the refrigerant is filled.

Furthermore, as is well known, the refrigerant condenser 2 is disposed at the forward end of the engine compartment of a motor vehicle (in front of the engine cooling radiator) and is cooled by a cooling fan which is also used for the engine cooling radiator.

Below is described the operation of the present embodiment. When the air conditioner for the motor vehicle is started and electric power is supplied to the magnetic clutch 1*a,* the magnetic clutch 1*a* turns ON, torque of the vehicle engine is transferred to the compressor 1, and the compressor 1 condenses and discharges the refrigerant.

The superheated gas refrigerant discharged from the compressor 1 flows from the inlet tube joint 26 into the upper compartment 21*a* of the first header tank 21 of the condenser 2, and from there passes through the upper tubes 24 of the condensing portion 38 as indicated by the arrow (a). The refrigerant then flows into the upper compartment 22*a* of the second header tank 22, turns around there as indicated by the arrow (b), and passes through the middle tubes 24 of the condensing portion 38. The refrigerant then flows into the middle compartment 21*b* of the first header tank 21, turns around there as indicated by the arrow (c), and passes through the lower tubes 24 of the condensing portion 38. The refrigerant then flows into the middle compartment 22*b* of the second header tank 22.

During the above process, heat of the gas refrigerant discharged from the compressor 1 is transferred to the cooling air via the tubes 24 and fins 25 to cool the gas refrigerant, and the gas refrigerant changes to the saturated liquid refrigerant partially including gas refrigerant. The saturated liquid refrigerant flows from the middle compartment 22*b* into the upper space in the liquid receiver 31 through the communication pipe 32 as indicated by the arrows (d), (e).

At the same time, the refrigerant in the middle compartment 22*b* flows into the lower space in the liquid receiver 31 through the communication hole 33 as indicated by the arrow (f). Then, the gas and liquid in the refrigerant are separated, and the liquid refrigerant is accumulated, in the liquid receiver 31. The liquid refrigerant in the lower space in the liquid receiver 31 flows into the lower compartment 22*c* of the second header tank 22 through the communication hole 37 as indicated by the arrow (f), and then passes through the tubes of the supercooling portion 39.

In the supercooling portion 39, the liquid refrigerant is cooled again to become a supercooled state. The supercooled refrigerant flows out from the outlet tube joint 27 to the outside of the condenser 2 through the lower compartment 21*c* of the first header tank 21.

The supercooled refrigerant then flows into the thermostatic expansion valve 4 through the sight glass 3. By the expansion valve, the pressure of the supercooled refrigerant is reduced, and the refrigerant is changed to the low temperature and low pressure refrigerant having two phases, gas and liquid. Then, the evaporator 5 transfers the heat of the air for the air conditioner to the refrigerant having two phases, gas and liquid, to evaporate the refrigerant, and the refrigerant absorbs the evaporation latent heat, from the air to be cooled, to cool the air. The gas refrigerant evaporated by the evaporator 5 is taken in and compressed again by the compressor 1.

Next, the improvement of the refrigerant filling characteristic due to the formation of "the paths of the refrigerant flowing into the upper and lower parts of the liquid receiver 31 through the communication pipe 32 and communication hole 33 respectively" is described based on the data of the experiments.

Figure 2:
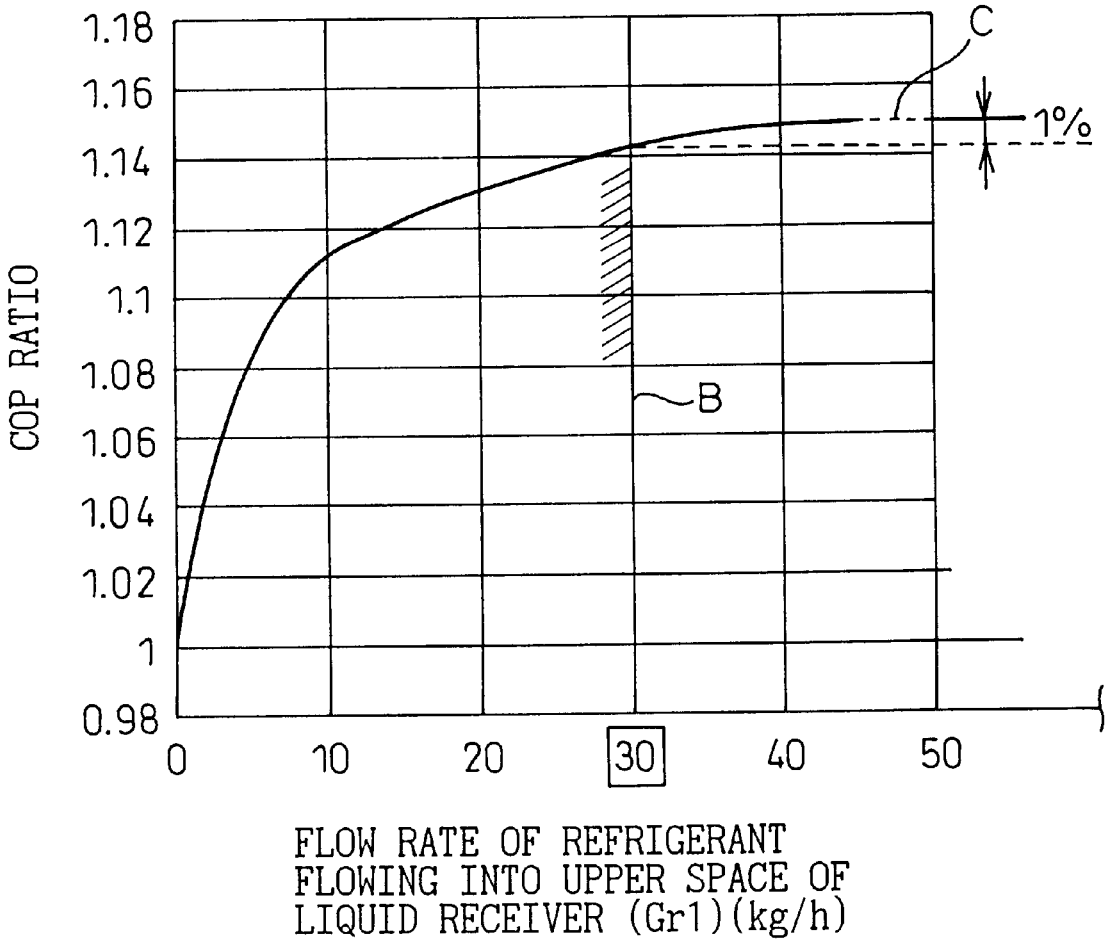
FIG. 2 is a graph of the result of experiments concerning refrigerant filling characteristics of refrigeration cycles.

In FIG. 2, the ordinate axis indicates the COP (Coefficient of Performance) ratio and the abscissa axis indicates the flow rate (Gr1) of the refrigerant flowing into the upper part of the liquid receiver 31 from the communication pipe 32. FIG. 2 provides the coordinates in the case that the liquid receiver 31 is heated under the condition mentioned below. The COP (cooling ability compressor power) in case that Gr1 is zero, is defined as the reference value "1". COP ratio is a ratio of COP in case that the flow rate Gr1 of the refrigerant flowing into the upper space of the liquid receiver is set up to the COP in the case that Gr1 is zero.

The refrigeration cycle apparatus on which the experiment in FIG. 2 has been conducted, is an air conditioner for light car use. The experiment has been conducted under the following principal conditions.

(a) Temperature of cooling air at the inlet of the condenser 2: 30° C.

(b) Velocity of cooling air at the inlet of the condenser 2: 1.5 m/s (c) Temperature of air taken in the evaporator: 27° C.

(d) Humidity of air taken in by the evaporator: 50% RH (e) Number of revolution of the compressor 1: 1000 rpm (at engine idling) In addition, the liquid receiver 31 has been set to be heated up to the saturation temperature of the refrigerant in the liquid receiver plus 20° C. Since the interface between gas and liquid in the refrigerant is formed in the liquid receiver 31, the refrigerant in the liquid receiver 31 is basically in the saturation state. Hence, in this embodiment, the liquid receiver 31 is heated up to the temperature which is 20° C. higher than the temperature of the refrigerant in the liquid receiver 31.

When the liquid receiver is mounted in the actual vehicle, the liquid receiver is heated due to the difference between the temperatures of upper and lower refrigerants in the second header tank 22 described in Japanese Unexamined Patent Publication No. 2000-74527, or due to the turning of the hot air in the engine compartment at engine idling (the phenomenon in which the hot air which has passed through the condenser and radiator turns to the front of the condenser at engine idling). The latter has a larger influence on heating than the former. Considering this fact, it is designed that the liquid receiver 31 is heated up to the refrigerant saturation temperature plus 20° C. in the most severe heating condition arising at hot air turning in the case that the liquid receiver is mounted on an actual vehicle.

As understood from the experimental data in FIG. 2, the COP ratio increases with an increase in the flow rate (Gr1) of the refrigerant flowing into the upper part of the liquid receiver, and thereby the cycle efficiency is improved, for the following reason.

When the flow rate of the refrigerant flowing into the upper part of the liquid receiver (Gr1) is small, the wall surface of the upper part of the liquid receiver 31 cannot be cooled adequately by the refrigerant flowing into the upper part of the liquid receiver 31. In this case, the refrigerant (saturated refrigerant) in the upper part of the liquid receiver 31 is vaporized and changed to the gas refrigerant by the heat from the outside. This means that liquid level of the liquid refrigerant in the liquid receiver 31 is restricted to a relatively low level in the case that the amount of refrigerant filled into the cycle is increased when the refrigerant is filled into the cycle.

As a result, it becomes difficult to increase the level of the liquid refrigerant in the liquid receiver 31 when the refrigerant is filled into the cycle, and the liquid refrigerant cannot be accumulated to the level higher than the restricted level, and thereby the refrigerant having no place to go overflows into the condenser 2, which fact increases the required heat radiation ability of the condenser 2. Hence an increase in the cycle high pressure results, and the COP is consequently reduced.

On the other hand, when the flow rate of the refrigerant flowing into the upper part of the liquid receiver (Gr1) is increased, the wall surface of the upper part of the liquid receiver 31 can be cooled adequately by the refrigerant flowing into the upper part of the liquid receiver 31 and, thereby, evaporation of the liquid refrigerant in the upper part of the liquid receiver 31 may also be restricted in the severe heating condition set forth above. As a result, the liquid level of the refrigerant in the liquid receiver 31 may be increased by increasing the amount of the refrigerant filled in the cycle when the refrigerant is filled in the cycle, and thereby the space in the liquid receiver may be effectively used for accumulating the liquid refrigerant up to the upper part.

For this reason, it may be prevented that the refrigerant to be originally accumulated in the liquid receiver 31 overflows into the condenser, and thereby it may be prevented that COP becomes worse.

The liquid receiver mounted in the actual vehicle is heated (damaged) due to the turning of the hot air at engine idling, and the flow rate of the refrigerant in the cycle decreases with decreasing the number of revolution of the compressor at engine idling. However, as shown in FIG. 2, when the flow rate (Gr1) of the refrigerant flowing into the upper part of the liquid receiver is increased to 30 kg/h indicated by line B or more, the COP ratio increases to 1.14 or more. In FIG. 2, the line C indicates a COP ratio of approx. 1.15 in case that the liquid receiver 31 is not heated. Thus, when Gr1 is increased to 30 kg/h or more, COP is improved to a level approx. 1% less than the level in case that the liquid receiver is not heated.

For this reason, in the present invention, the flow rate (Gr1) of the refrigerant flowing into the upper part of the liquid receiver is restricted to 30 kg/h or more. On the other hand, when the refrigerant of excessive flow rate (Gr1) flows into the upper part of the liquid receiver 31, the dynamic pressure in the case that the refrigerant flows into the upper part of the liquid receiver 31 from the outlet of the communication pipe 32 acts on the liquid level of the refrigerant strongly to make the liquid level of the refrigerant unstable, and hence the gas refrigerant in the liquid receiver 31 flows into the supercooling portion 39. For this reason, when the refrigerant to be filled into the cycle is being increased, the amount of the refrigerant increase which has been filled till the time (called "bubble disappearing time" hereinafter) when the gas refrigerant disappears from the liquid refrigerant at the outlet of the supercooling portion 39. That is, the bubble disappearing characteristic during refrigerant filling becomes worse.

Figure 3:
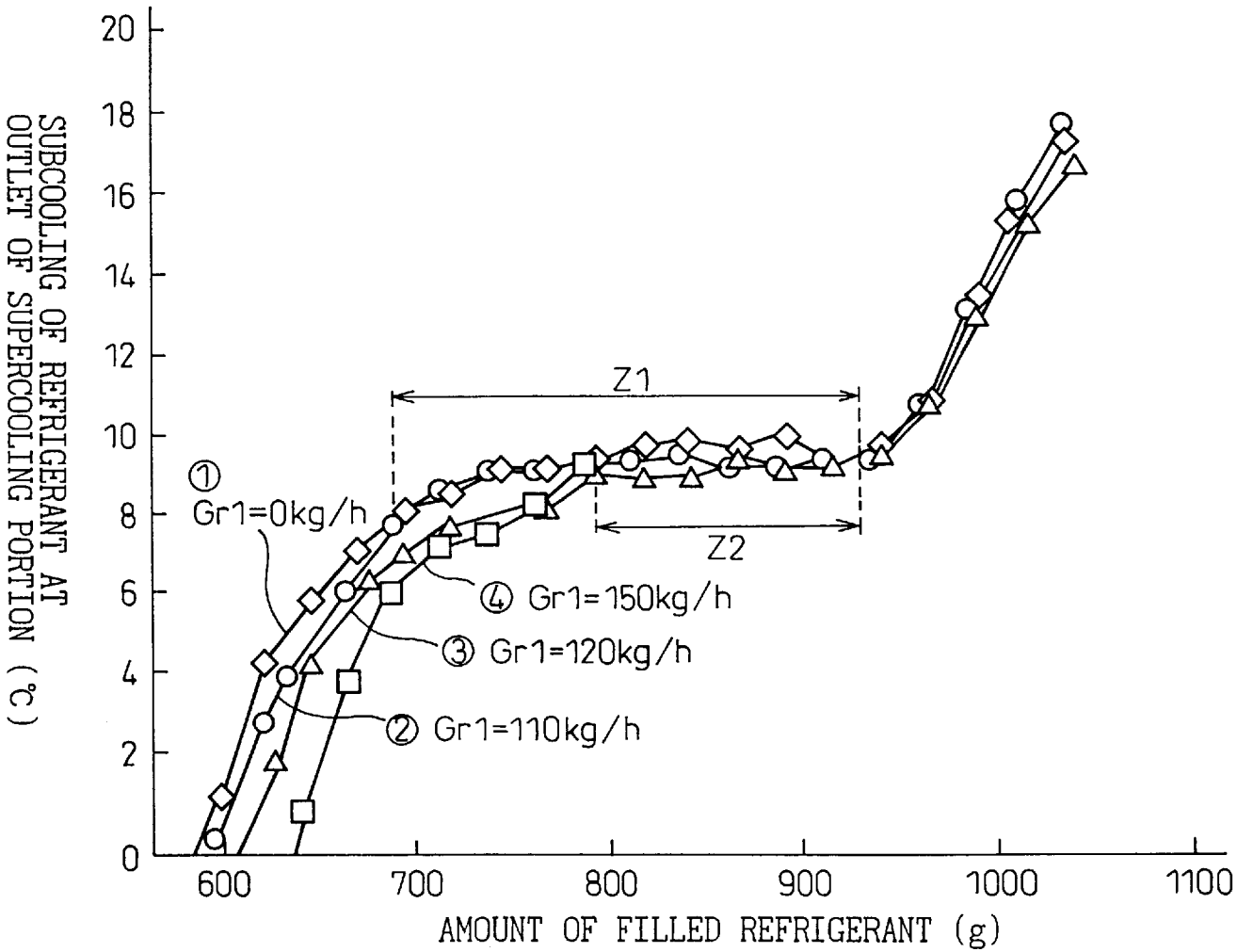
FIG. 3 is a graph of the result of experiments concerning refrigerant filling characteristics of refrigeration cycles.

FIG. 3 shows the experimental data which indicates the degree of influence of the flow rate of the refrigerant flowing into the upper part of the liquid receiver 31 on the bubble disappearance characteristic in the refrigerant filling characteristic. In FIG. 3, the axis of ordinate indicates the subcooling (degree of supercooling) of the refrigerant at the outlet of the supercooling portion 39 of the condenser 2, and the axis of abscissa indicates the amount of the refrigerant filled into the cycle. The experiment shown in FIG. 3 has been conducted under the following refrigerant filling conditions.

(a) Temperature of cooling air at the inlet of the condenser 2: 35° C.

(b) Velocity of cooling air at the inlet of the condenser 2: 2.5 m/s (c) Temperature of air taken in the evaporator 30° C.

(d) Humidity of air taken in the evaporator: 50% RH (e) Number of revolution of the compressor 1: 1500 rpm In FIG. 3, (1) to (4) indicate the refrigerant filling characteristics in the case of different flow rates (Gr1) of the refrigerant flowing into the upper part of the liquid receiver. (1) indicates the refrigerant filling characteristic in the case of Gr1=0 kg/h, (2) indicates the characteristic in the case of Gr1=110 kg/h, (3) indicates the characteristic in the case of Gr1=120 kg/h, and (4) indicates the characteristic in the case of Gr1=150 kg/h.

In case of Gr1=0 kg/h (1), since instability of the liquid level of the refrigerant due to the dynamic pressure of the refrigerant flowing into the upper part of the liquid receiver 31 does not arise, the bubble disappearance characteristic is the best as a matter of course, and the amount of the refrigerant filled into the cycle till the bubble disappearing time is minimum. For this reason, the stabilized subcooling zone Z1 in which the subcooling value may be kept in substantially constant value (about 9° C.) may be set in the range where the amount of the refrigerant filled into the cycle is about 700 g to 950 g. In addition, it is apparent that the stabilized subcooling zone may be set to substantially the same zone as Z1 described above also in case of Gr1=110 kg/h (2).

On the other hand, in both cases of Gr1=120 kg/h (3) and Gr1=150 kg/h (4), it is clear that the bubble disappearance characteristic becomes worse, and the amount of the refrigerant filled into the cycle, until the bubble disappearing time, increases and, thereby, the amount of the refrigerant filled into the cycle until the stabilized subcooling zone also increases. For this reason, in both cases of (3) and (4), the stabilized subcooling zone is reduced to the zone Z2 (the amount of refrigerant filled into the cycle is approximately between 800 g and 950 g).

By the way, some variation of the amount of the refrigerant filled into the cycle cannot be avoided during actual work to fill the refrigerant into the cycle. Hence, the narrow stabilized subcooling zone is apt to results an undesired state where a variation in the amount of the refrigerant filled into the cycle makes the subcooling value lower than a substantially constant value (about 9° C.) in the stabilized zone, thereby decreasing the cooling ability, but on the other hand, variation of the amount of the refrigerant filled into the cycle makes the subcooling value larger than substantially constant value (about 9° C.) in the stabilized zone, thereby increasing the compressor power by increasing the cycle high pressure.

On the contrary, by restricting the flow rate (Gr1) of the refrigerant flowing into the upper part of the liquid receiver to 110 kg/h or less, instability of the liquid level of the refrigerant due to the dynamic pressure of the refrigerant flowing into the upper part of the liquid receiver 31 is restricted and, thereby, the bubble disappearing characteristic may be kept in a good state.

That is, by setting the flow rate (Gr1) of the refrigerant flowing into the upper part of the liquid receiver to 30 kg/h to 110 kg/h, preventing the COP from becoming worse due to heat given to the liquid receiver 31 from the outside, and preventing the bubble disappearing characteristic from becoming worse due to the dynamic pressure of the refrigerant flowing into the upper part of the liquid receiver 31, may be mutually compatible.

Figure 4:
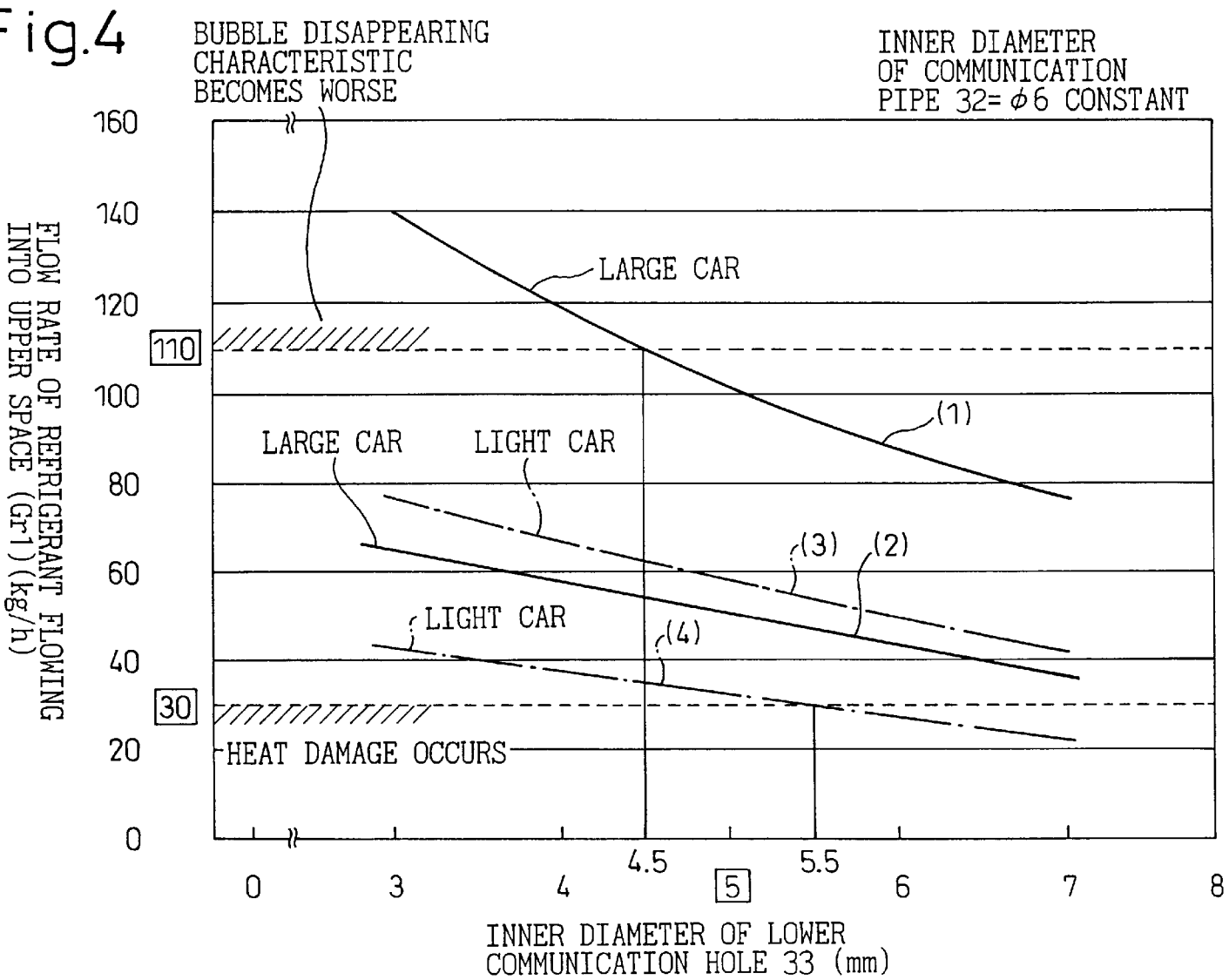
FIG. 4 is a graph of the result of experiments concerning refrigerant filling characteristics of refrigeration cycles.

By the way, the cooling ability necessary for a refrigeration cycle apparatus of an air conditioner for a motor vehicle varies depending on the vehicle size, and the flow rate of the refrigerant circulating in the cycle varies accordingly. In addition, the flow rate of the refrigerant circulating in the cycle also varies according to the thermal load conditions for cooling, such as outside air temperature, number of revolutions of the compressor, etc. For this reason, the refrigerant filling characteristic depending on the variation of the flow rate (Gr1) of the refrigerant flowing into the upper part of the liquid receiver has been evaluated for both a refrigeration cycle apparatus for a light car having small refrigerant flow rate and a refrigeration cycle apparatus for a large car (with a engine having displacement in the neighborhood of 4000 cc) having large refrigerant flow rate, and the summary of the result of the evaluation is shown in FIG. 4. In FIG. 1, the ordinate axis indicates the flow rate (Gr1) of the refrigerant flowing into the upper part of the liquid receiver, and the abscissa axis indicates the inner diameter of the communication hole 33 corresponding to the passage area of the communication hole 33 which is a means allowing the refrigerant to flow into the lower part of the liquid receiver 31. In the experiment indicated in FIG. 4, the inner diameter of the communication pipe 32 which is a means allowing the refrigerant to flow into the upper part of the liquid receiver 31 is a constant value of 6 mmϕ and, thereby, the flow rate (Gr1) of the refrigerant flowing into the upper part of the liquid receiver increases with a decrease in the inner diameter of the communication hole 33.

In FIG. 4, the continuous lines (1) and (2) indicate characteristics of a refrigeration cycle apparatus for large car, and the alternate long and short dash lines (3) and (4) indicate characteristics of a refrigeration cycle apparatus for light car. (1) and (3) are the characteristics under the high flow rate condition (outside air temperature: 30° C., number of revolution of compressor: 1500 rpm), and (2) and (4) are the characteristics under the low flow rate condition (outside air temperature: 20° C., number of revolution of compressor: 800 rpm at idle running).

In order to secure the good bubble disappearing characteristic, by keeping the flow rate of refrigerant flowing into the upper part of the liquid receiver 31 at the upper limit value 110 kg/h or less, the inner diameter of the communication hole 33 must be approximately 4.5 mm or more as indicated by the point of intersection of the line of the upper limit value (110 kg/h) and the continuous line (1). In the refrigeration cycle apparatus for light car, since the refrigerant flow rate is originally small, the inner diameter of the communication hole 33 need not be restricted in view of the bubble disappearing characteristic.

On the other hand, in order to prevent the liquid receiver 31 from heat damage due to the heat given to the liquid receiver 31, setting the flow rate (Gr1) of the refrigerant flowing into the upper part of the liquid receiver at the lower limit value 30 kg/h or more, the inner diameter of the communication hole 33 must be approx. 5.5 mm or less as indicated by the point of intersection of the line of the lower limit value (30 kg/h) and the alternate long and short dash line (4). In other words, in the refrigeration cycle apparatus for light car, the flow rate (Gr1) of the refrigerant flowing into the upper part of the liquid receiver decreases with a decrease in the refrigerant flow rate at idle running, but the flow rate (Gr1) of the refrigerant flowing into the upper part of the liquid receiver may be kept at the lower limit value 30 kg/h or more by setting the inner diameter of the communication hole 33 at approximately 5.5 mm or less.

Figure 5:
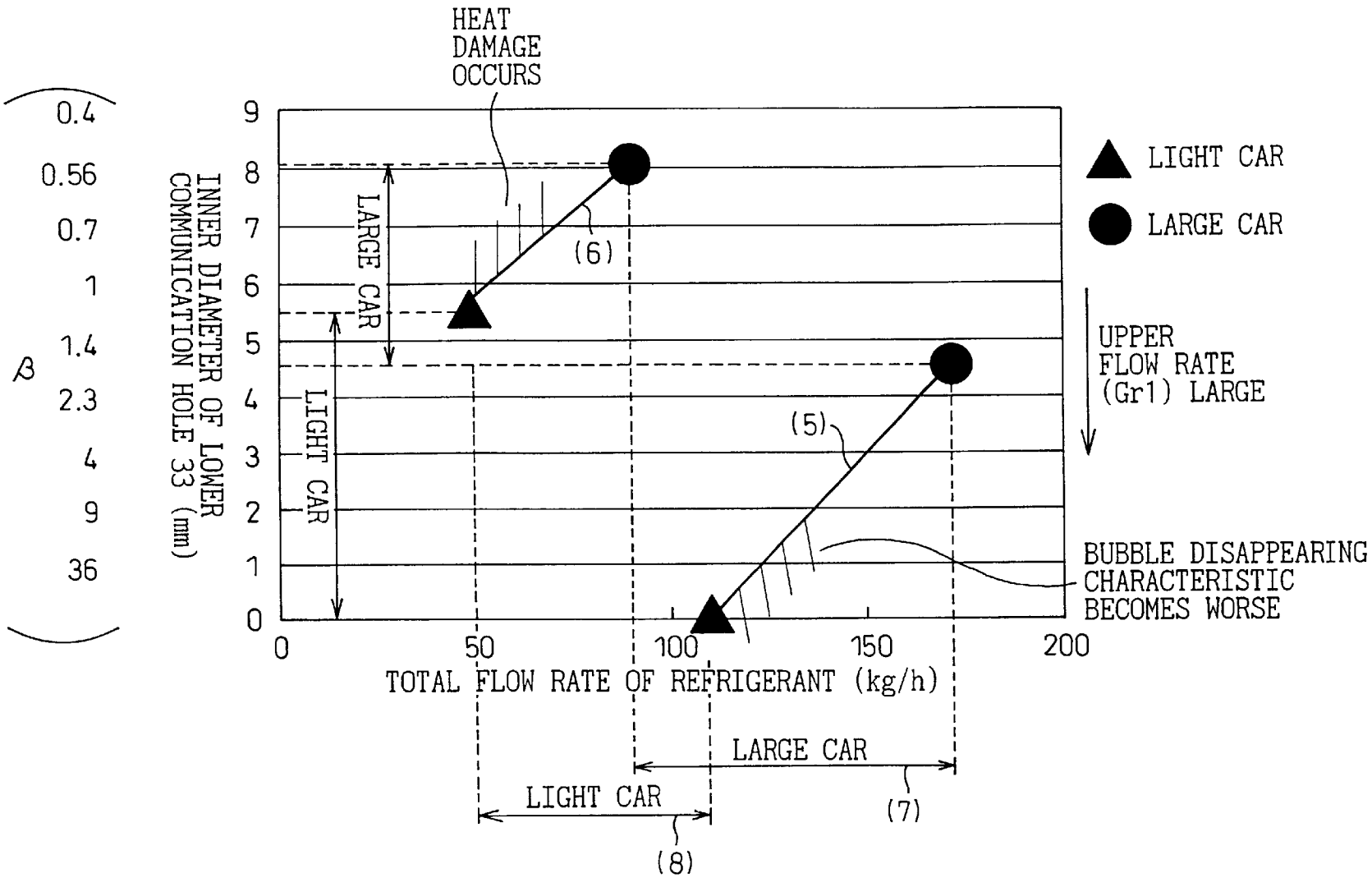
FIG. 5 is a graph of the result of experiments concerning refrigerant filling characteristics of refrigeration cycles.

As a result, in the case that the inner diameter of the communication pipe 32 is a constant value of 6 mmϕ, when the inner diameter of the communication hole 33 is set at a value between approx. 4.5 mm and approx. 5.5, securing the good bubble disappearing characteristic and preventing the liquid receiver 31 from heat damage due to the heat given to the liquid receiver 31 may be mutually compatible, in spite of the variation of vehicle size from light car to large car and the variation of the cycle operation condition. Furthermore, in FIG. 5, the summary of the result of the evaluation in FIG. 4 is shown for a parameter of a total refrigerant flow rate which is the sum of the flow rate (Gr1) of the refrigerant flowing into the upper part of the liquid receiver 31 and the flow rate (Gr2) of the refrigerant flowing into the lower part of the liquid receiver 31. In FIG. 5, the area right of the line (5) is the area in which the bubble disappearing characteristic is bad, and the area left of the line (6) is the area in which heat damage occurs.

In addition, in the refrigeration cycle apparatus for a large car, in case that the total refrigerant flow rate varies in the range of (7), when the inner diameter of the communication hole 33 is set at between approx. 4.5 mm and approx. 8.1, securing the good bubble disappearing characteristic and preventing the liquid receiver 31 from heat damage may be mutually compatible.

On the other hand, in the refrigeration cycle apparatus for light car, in case that the total refrigerant flow rate varies in the range of (8), when the inner diameter of the communication hole 33 is set at approx. 5.5 mm or less, securing the good bubble disappearing characteristic and preventing the liquid receiver 31 from heat damage may be mutually compatible.

The ratio of the inner diameter (6 mmϕ) of the communication pipe 32 to the inner diameter (approx. 4.5 mm to approx. 5.5 mm), with which securing the good bubble disappearing characteristic and preventing the liquid receiver 31 from heat damage may be mutually compatible, is 6/4.5 to 6/5.5=1.33 to 1.09, regardless of the variation of vehicle size (refrigerant flow rate). The ratio is converted to the ratio between passage areas as indicated by β on the axis of ordinate in FIG. 5. That is, β=passage area of communication pipe 32 (A1)/passage area of communication hole 33 (A2). Thus, the ratio of passage areas (β) for the inner diameter of the communication hole 33 (approx. 4.5 mm to approx. 5.5 mm) is, β=1.78 to 1.19.

As mentioned above, when the ratio of the area of the upper passage of the refrigerant flowing into the liquid receiver to the area of the lower passage area flowing into the liquid receiver (β) is set at a value between approx. 1 and 2, securing the good bubble disappearing characteristic and preventing the liquid receiver 31 from heat damage may be mutually compatible, regardless of the variation of vehicle size (refrigerant flow rate).

(Second Embodiment)

Figure 6:
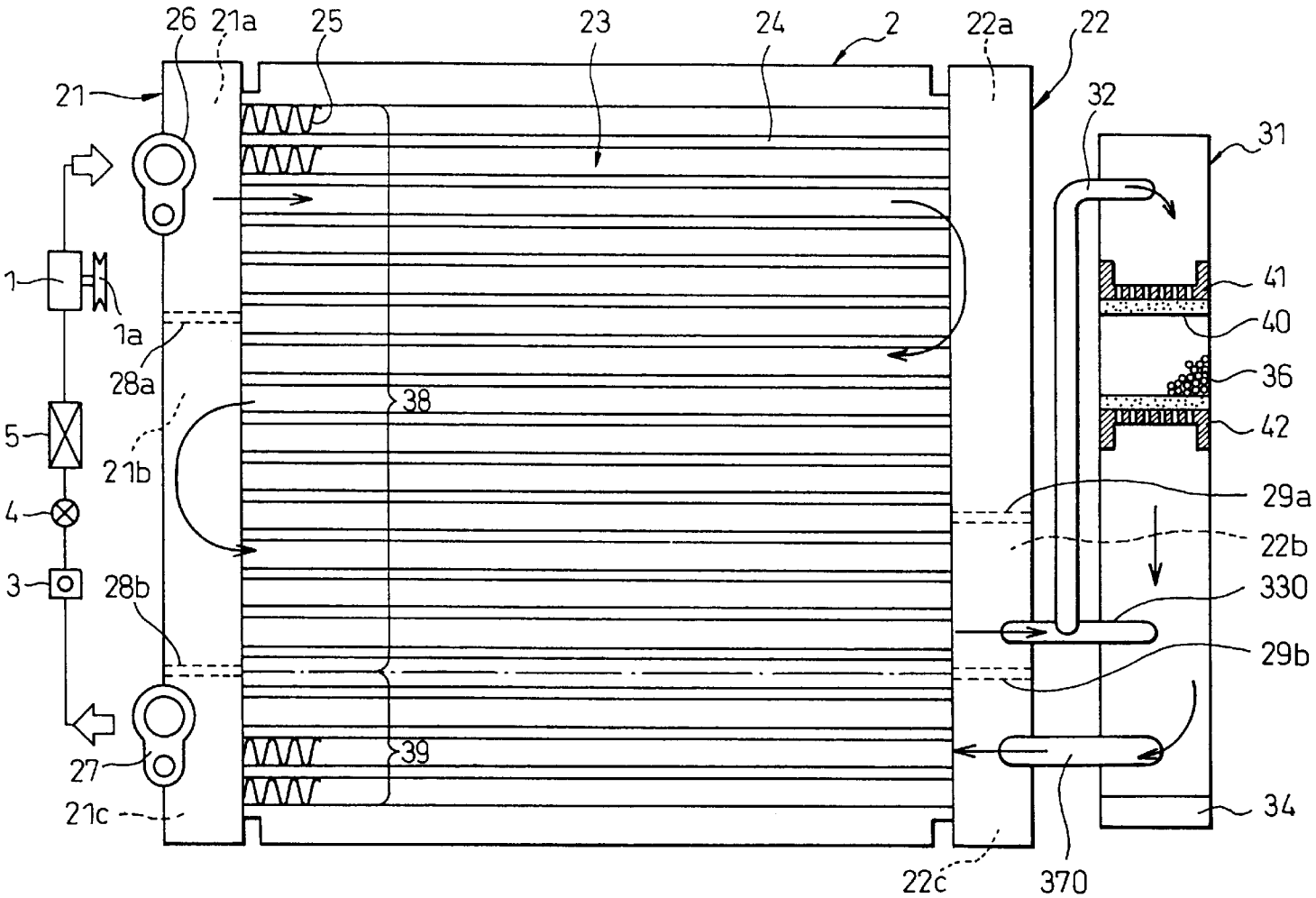
FIG. 6 is a front view of a refrigerant condenser of the second embodiment of the present invention, including a sectional view of a liquid receiver.

FIG. 6 shows the second embodiment of the present invention, in which the liquid receiver 31 is separated from the condenser 2. For this purpose, a communication pipe 330 is provided instead of the communication hole 33 which is a means allowing the refrigerant to flow into the lower part of the liquid receiver 31 in the first embodiment, and by this communication pipe 330, the middle compartment 22*b* in the second header tank 22*a* of the condenser 22 is communicated with the lower space in the liquid receiver 31. In addition, a communication pipe 370 is provided instead of the communication hole 37 which is a means allowing the refrigerant to flow out from the liquid receiver 31 in the first embodiment, and by this communication pipe 370, the lower space in the liquid receiver 31 is communicated with the lower compartment 22*c* in the second header tank 22*a*.

On the other hand, the lower end of the communication pipe 32 is communicated with the middle portion of the communication pipe 330. For this reason, the refrigerant which has flowed into the communication pipe 330 from the middle compartment 22*b* branches to the communication pipe 32 and flows into the upper part of the liquid receiver 31.

Furthermore, in the second embodiment, the internal configuration of the liquid receiver 31 is changed so that a desiccant 36 is disposed between the end portion of the communication pipe 32 from which the refrigerant flows into the liquid receiver 31 and the end portion of the communication pipe 330 from which the refrigerant flows into the liquid receiver 31. The desiccant 36 is a particulate desiccant which is supported by the upper and lower supporting plates 41 and 42, and via a felt filter 40, which are fixed to the inner wall of the liquid receiver 31. The supporting plates 41 and 42 consist of a multi-hole plate having a number of small holes which allow passage of the refrigerant or consist of a net.

Also in the second embodiment, the passage area ratio between the communication pipe 32 (a means allowing the refrigerant to flow into the upper part of the liquid receiver 31) and the communication hole 330 (a means allowing the refrigerant to flow into the lower part of the liquid receiver 31) is set based on the same concept as the first embodiment so that the flow rate of the refrigerant flowing into the upper part of the liquid receiver 31 is set to a value in the same range as the first embodiment, and thereby an improved refrigerant filling characteristic can be obtained.

(Third Embodiment)

Figure 7:
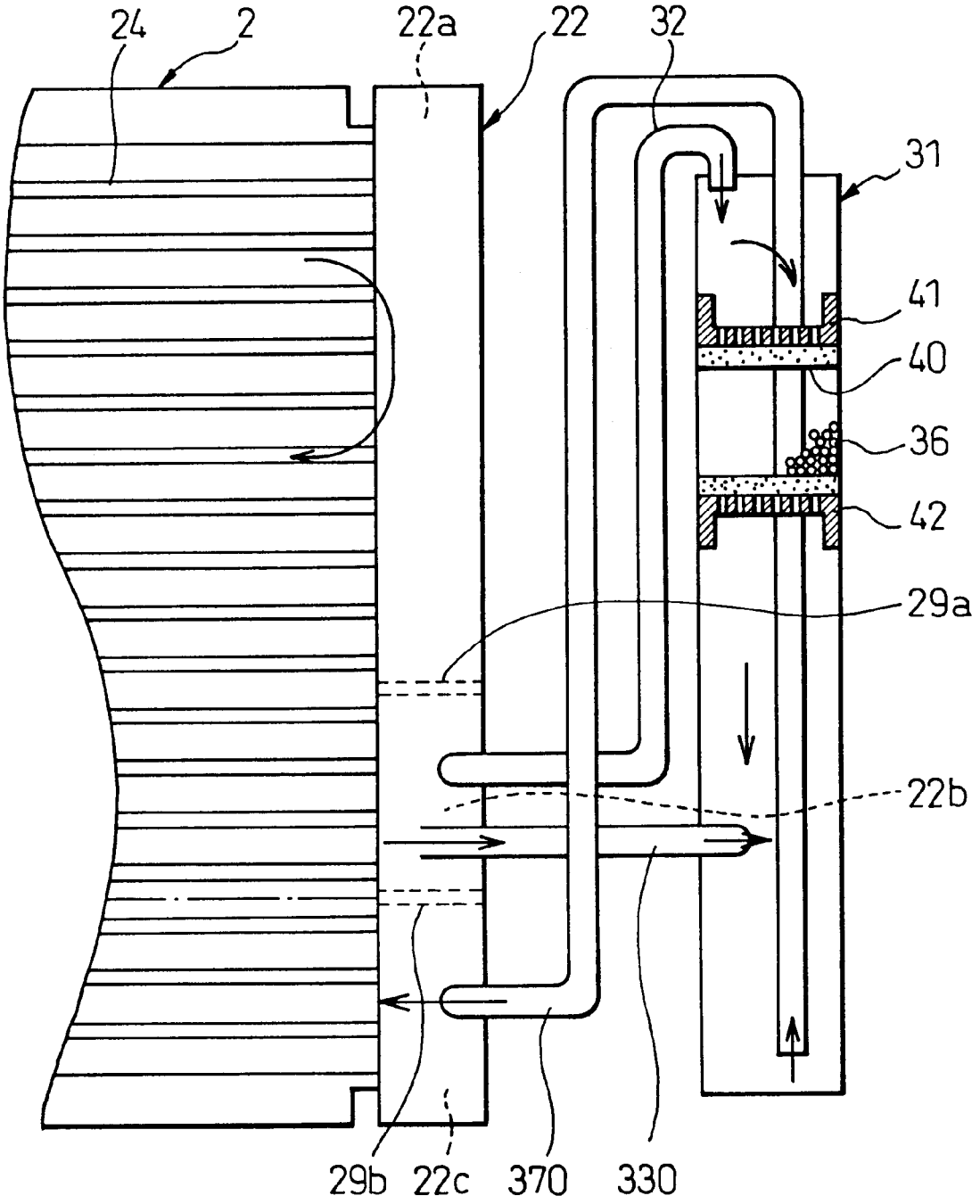
FIG. 7 is a front view of the main part of a refrigerant condenser of the third embodiment of the present invention, including a sectional view of a liquid receiver.

FIG. 7 shows the third embodiment of the present invention, which is a variation of the second embodiment. The first point where the third embodiment is different from the second embodiment is that the lower end of the communication pipe 32 (refrigerant inlet portion) is directly communicated with the middle compartment 22*b* of the second header tank 22*a*.

The second point where the third embodiment is different from the second embodiment is that the communication pipe 370, which is a means allowing the refrigerant to flow out from the liquid receiver 31, is inserted in the liquid receiver 31 from the top of the liquid receiver 31. The communication pipe 370 extends to the lower part of the liquid receiver 31 through the middle portion of the desiccant 36 inside of the liquid receiver 31, and the liquid refrigerant near the bottom of the liquid receiver 31 flows into the communication pipe 370 from the lower end thereof.

(Fourth Embodiment)

Figure 8:
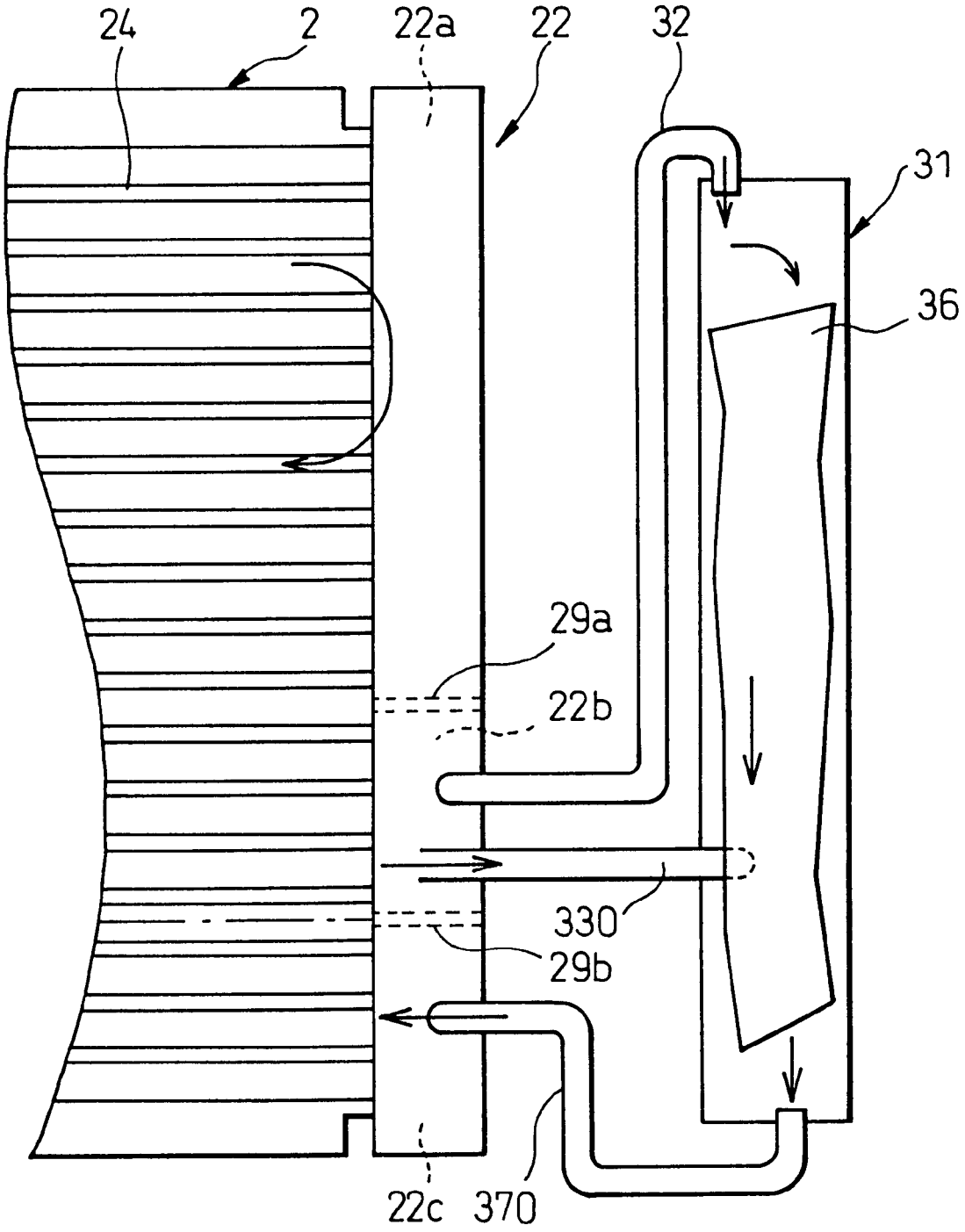
FIG. 8 is a front view of the main part of a refrigerant condenser of the fourth embodiment of the present invention, including a sectional view of a liquid receiver.

FIG. 8 shows the fourth embodiment of the present invention, which is a variation of the third embodiment. The communication pipe 370, which is a means allowing the refrigerant to flow out from the liquid receiver 31, opens to the inside of the liquid receiver 31 at the bottom of the liquid receiver 31. In the fourth embodiment, a desiccant 36 is accommodated in a suitable bag as in the first embodiment.

The present invention is not restricted to the embodiments described above, and various variations of the embodiments may be provided. For example, in the first embodiment, although the liquid receiver is integrated with the second header tank 22 on which the inlet and outlet tube joints 26, 27 for refrigerant are not provided, the liquid receiver 31 may be integrated with the first header tank 21 on which the inlet and outlet tube joints 26, 27 for refrigerant are provided.

In addition, the spirit of the present invention may be implemented in a condenser which is configured so that the core portion of the condenser has only the condensing portion 38 and the supercooling portion 39 is separated from the core portion 38. In this case, the outlet tube joint 27 on the first header tank 21 may be deleted, and instead of that a outlet tube joint (refrigerant discharge portion), which allows the liquid refrigerant in the liquid receiver 31 to flow out, may be provided on the liquid receiver 31, so that the liquid refrigerant from the outlet tube joint may be allowed to flow into the supercooling portion through a tube.

Furthermore, the spirit of the present invention may be implemented in a refrigeration cycle apparatus having no supercooling portion.

While the invention has been described by reference to specific embodiments chosen for purpose of illustration, it should be apparent that numerous modification could be made thereto by those skilled in the art without departing from the basic concept and scope of the invention.

What is claimed is:

1. A refrigerant cycle apparatus comprising a condenser (2) which cools the superheated refrigerant gas discharged from a compressor (1) to condense the superheated refrigerant gas, and a liquid receiver (31) which separates gas and liquid in the refrigerant which has passed through said condenser (2) to accumulate the liquid refrigerant, the refrigerant cycle apparatus further comprising an upper refrigerant flow-in means (32) allowing the refrigerant which has passed through said condenser (2) to flow into the upper part of said liquid receiver (31) and a lower refrigerant flow-in means (33, 330) allowing the refrigerant which has passed through said condenser (2) to flow into the lower part of said liquid receiver (31), wherein the flow rate (Gr1) of refrigerant flowing into the upper part of said liquid receiver (31) from said upper refrigerant flow-in means (32) is set at a value between 30 kg/h and 110 kg/h.

2. The refrigerant cycle apparatus according to claim 1, wherein the ration (A1/A2) of the passage area (A1) of said upper refrigerant flow-in means (32) to the passage area (A2) of said lower refrigerant flow-in means (33, 330) is a value between 1 and 2.

3. The refrigerant cycle apparatus according to claim 1, wherein header tank (21, 22) connecting tubes (24) in which the refrigerant flows are arranged on said condenser (2) so as to extend in vertical direction; said liquid receiver (31) is integrated with said header tank (21, 22); said upper refrigerant flow-in means (32) is formed in pipe style; and said lower refrigerant flow-in means (33) is a communication hole which is formed through the walls of said header tank (21, 22) and said liquid receiver (31).

4. The refrigerant cycle apparatus according to claim 2, wherein header tank (21, 22) connecting tubes (24) in which the refrigerant flows are arranged on said condenser (2) so as to extend in vertical direction; said liquid receiver (31) is integrated with said header tank (21, 22); said upper refrigerant flow-in means (32) is formed in pipe style; and said lower refrigerant flow-in means (33) is a communication hole which is formed through the walls of said header tank (21, 22) and said liquid receiver (31).

5. The refrigerant cycle apparatus according to claim 1, wherein header tank (21, 22) connecting tubes (24) in which the refrigerant flows are arranged on said condenser (2) so as to extend in vertical direction; said liquid receiver (31) is separated from said header tank (21, 22); and both of said upper refrigerant flow-in means (32) and said lower refrigerant flow-in means (330) are formed as pipes.

6. The refrigerant cycle apparatus according to claim 2, wherein header tank (21, 22) connecting tubes (24) in which the refrigerant flows are arranged on said condenser (2) so as to extend in vertical direction; said liquid receiver (31) is separated from said header tank (21, 22); and both of said upper refrigerant flow-in means (32) and said lower refrigerant flow-in means (330) are formed as pipes.

* * * * *